US012290161B2

(12) United States Patent
Jensen

(10) Patent No.: US 12,290,161 B2
(45) Date of Patent: May 6, 2025

(54) SYSTEM AND METHOD FOR A BACKPACKING BACKPACK

(71) Applicant: Outdoor Gear Company, LLC, Mesa, AZ (US)

(72) Inventor: Scott Jensen, Mesa, AZ (US)

(73) Assignee: Outdoor Gear Company, LLC, Mesa, AZ (US)

( * ) Notice: Subject to any disclaimer, the term of this patent is extended or adjusted under 35 U.S.C. 154(b) by 184 days.

(21) Appl. No.: 18/073,247

(22) Filed: Dec. 1, 2022

(65) Prior Publication Data

US 2023/0397710 A1 Dec. 14, 2023

Related U.S. Application Data

(60) Provisional application No. 63/350,020, filed on Jun. 8, 2022.

(51) Int. Cl.
*A45F 3/08* (2006.01)
*A45F 3/04* (2006.01)

(52) U.S. Cl.
CPC ..... *A45F 3/08* (2013.01); *A45F 2003/045* (2013.01)

(58) Field of Classification Search
CPC ..... A45F 2003/045; A45F 3/04; A45F 3/08; A45F 3/46; A45F 3/06; A45F 2003/003; A45C 2013/026; A45C 13/02
USPC ..... 224/261
See application file for complete search history.

(56) References Cited

U.S. PATENT DOCUMENTS 11,033,086 B2 * 6/2021 Tedesco ..... A45C 13/02
2022/0257000 A1 * 8/2022 Bartlett ..... A61B 50/30

FOREIGN PATENT DOCUMENTS

FR 2777757 A1 * 10/1999 ..... A45C 13/02

OTHER PUBLICATIONS

FR-2777757-A1 Translation, Gram T, Oct. 29, 1999 (Year: 1999).*

* cited by examiner

*Primary Examiner* — Nathan J Newhouse
*Assistant Examiner* — Matthew T Theis
(74) *Attorney, Agent, or Firm* — Holland & Hart LLP

(57) ABSTRACT

A backpack includes a frame, a pack attached to the frame to define an interior space, and at least one divider positioned within the interior space to define at least one compartment within the interior space. The frame and the pack define a horizontal direction, a vertical direction, and a depth direction within the backpack. The compartment positions at least one equipment within the interior space such that a center of mass of the backpack is centered on a backpacker's back when the backpacker is wearing the backpack centered in the horizontal direction and the vertical direction within the interior space.

15 Claims, 10 Drawing Sheets

SYSTEM AND METHOD FOR A BACKPACKING BACKPACK

CROSS REFERENCE TO RELATED APPLICATIONS

This application is related to and claims priority under 35 U.S.C. 119 from U.S. Provisional Application No. 63/350,020 filed Jun. 8, 2022, entitled "Backpack," the entire contents of which are fully incorporated by reference herein for all purposes.

BACKGROUND OF CERTAIN ASPECTS OF THE DISCLOSURE

Backpacking is a popular outdoor recreational activity where a backpacker hikes a long distance carrying their gear in a backpack. The gear may include food, water, bedding, shelter, clothing, cooking equipment, survival gear, and/or other typically essential equipment. Backpacking trips typically range from one night to weeks or months in duration. The total weight of a backpack and its contents is of primary concern of backpackers given that backpackers must carry their gear with them over long distances. A lower weight backpack will be easier for the backpacker to carry over rough terrain.

Another primary concern to a backpacker is how the backpack is packed. For example, if the backpack is not properly organized, the backpack may not have room for all of the backpacker's essential gear. Additionally, if the backpack does have room for all of the backpacker's essential gear but is not organized in such a way to maximize the ergonomic comfort of the backpacker, the backpacker may experience discomfort and/or injury during the hike. Finally, at least some known backpacks include a primary opening at the top of the backpack. This opening enables large items such as tents and sleeping bags to fit into the backpack. However, because the opening is at the top, most of the contents of the backpack have to be removed in order to access items at the bottom of the backpack. Accordingly, there is a need for a lightweight backpack with a convenient primary opening that organizes contents to maximize the ergonomic comfort of the backpacker.

BRIEF SUMMARY OF SOME ASPECTS OF THE DISCLOSURE

A number of embodiments of a backpack and a method of packing a backpack are presented in this application. The embodiments described herein include a backpack. The backpack includes a frame, a pack attached to the frame to define an interior space, and at least one divider positioned within the interior space to define at least one compartment within the interior space. The frame and the pack define a horizontal direction, a vertical direction, and a depth direction within the backpack. The compartment positions at least one equipment within the interior space such that a center of mass of the backpack is centered on a backpacker's back when the backpacker is wearing the backpack centered in the horizontal direction and the vertical direction within the interior space.

The embodiments described herein also include a backpack. The backpack includes a frame, a pack attached to the frame to define an interior space, and a front panel opening. The front panel opening has an area that is approximately 60% to 80% of a front of the backpack.

The embodiments described herein also include a method of constructing a backpack. The method includes providing a frame. The method also includes attaching a pack to the frame to define an interior space. The method further includes positioning at least one divider within the interior space to define at least one compartment within the interior space. The method also includes positioning at least one equipment in the at least one compartment such that a center of mass of the backpack is centered on a backpacker's back when the backpacker is wearing the backpack and centered in a horizontal direction of the backpack and a vertical direction of the backpack within the interior space.

There are other novel aspects and features of this disclosure. They will become apparent as this specification proceeds. Accordingly, this brief summary is provided to introduce a selection of concepts in a simplified form that are further described below in the detailed description. The summary and the background are not intended to identify key concepts or essential aspects of the disclosed subject matter, nor should they be used to constrict or limit the scope of the claims. For example, the scope of the claims should not be limited based on whether the recited subject matter includes any or all aspects noted in the summary and/or addresses any of the issues noted in the background.

DRAWINGS

The preferred and other embodiments are disclosed in association with the accompanying drawings in which.

DETAILED DESCRIPTION

Figure 1:
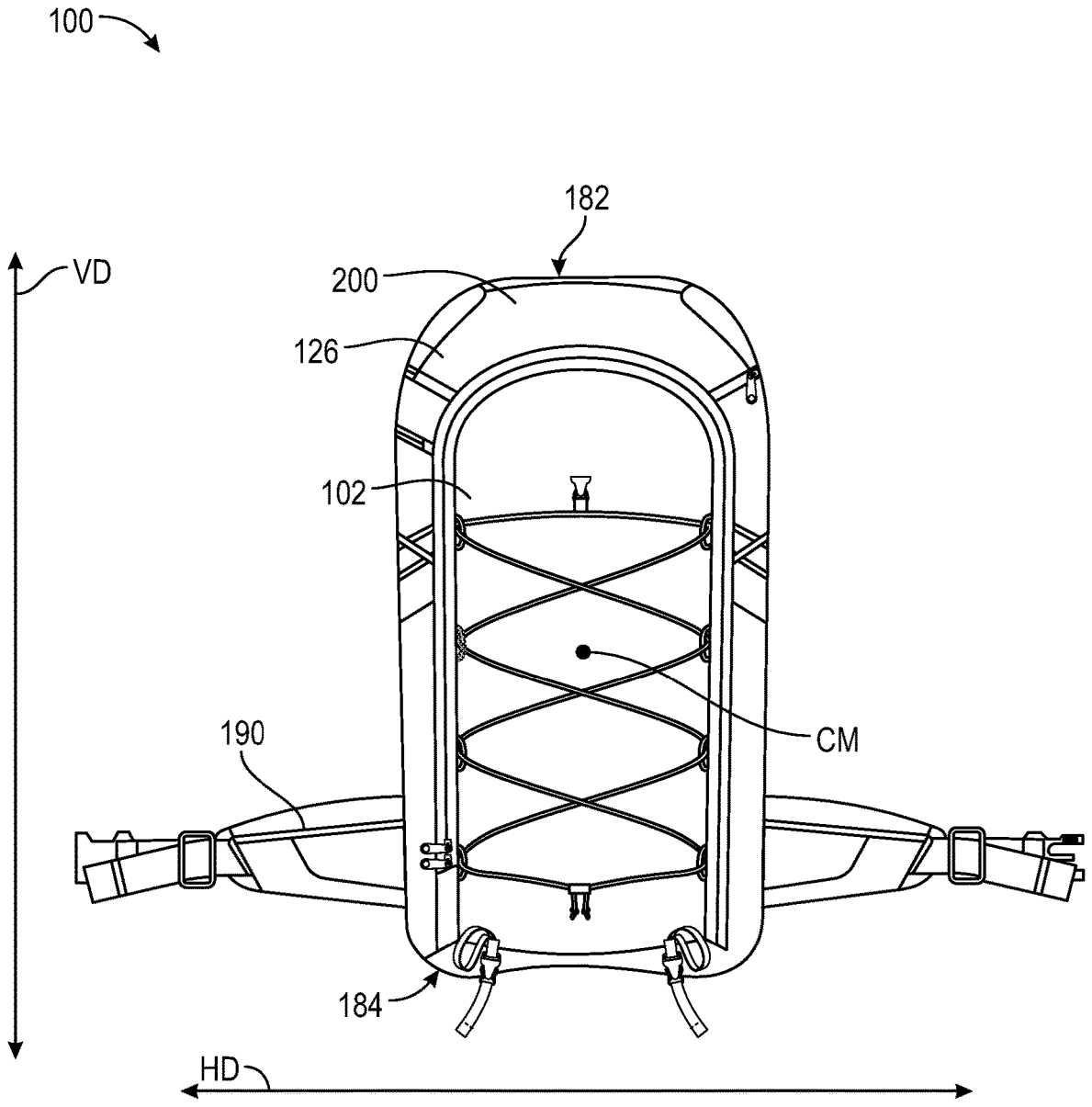
FIG. 1 illustrates a front view of a backpack in accordance with aspects of the present disclosure.

A number of embodiments of a system and method of a backpacking backpack are presented in this application. In general, backpacking is an outdoor recreation where gear is carried in a backpack. The gear may include food, water, bedding, shelter, clothing, cooking equipment, survival gear, and/or other typically essential equipment. Backpacking trips range from one night to weeks or months, sometimes aided by planned resupply points, drops, or caches. As such, given that backpackers must carry their gear, the total weight of their bag and its contents is a primary concern of backpackers. The backpacking backpacks described herein are configured to enable a backpacker to carry all of their gear in an organized manner such that the backpack is light weight and balanced on the backpackers back.

Specifically, in some embodiments, the backpack includes a frame, a pack supported by the frame to define an interior space, and at least one divider positioned in the interior space to define at least one compartment. In the embodiments illustrated herein, the backpack includes a plurality of dividers that define a plurality of compartments. Each compartment is configured to contain a predetermined piece or pieces of equipment such that the compartments balance the weight of the gear on the backpackers back. The compartments arrange the backpacker's equipment on the backpacker's back such that the weight of the backpack is distributed for stability and comfort.

More specifically, the backpack is designed to direct the user how to properly load the backpack for maximum stability, comfort, and weight distribution. Each compartment of the backpack is labeled, with section panels to load the heaviest equipment (i.e., tent, main liquid supply) to be next to your back and centered in the pack. Medium weight gear (i.e., cookware, sleeping pad) is carried towards the top and outside portions of the pack, and lightweight gear (i.e., sleeping bag) is loaded on the bottom and centered. Mesh pockets are included on the inside front panel zipper opening for storage of food items and utensils. This also helps maximize weight distribution of the pack. The backpack includes a front panel opening with internal organization sections and screen-printed labeling along with internal removable section panels to direct the user where to place each item for proper organization and weight distribution. Additionally, the backpack allows users to quickly identify where to place their key items, as well as identify if each product has been placed in the pack to avoid forgetting key items. The organizational system and front panel opening also add additional value to the user by allowing the user to easily segregate their items and remove packed items from the bag upon use. Accordingly, the backpacks described herein enable a backpacker to quickly and efficiently load and locate their equipment and provides greater comfort to the backpacker because of the weight distribution of the equipment in the backpack.

The Backpack

FIG. 1 illustrates a front view of a backpack 100. The backpack 100 is a light weight or ultra-lightweight overnight hiking backpack that enables quick access to gear using a labeled, compartmentalized, and removable organizational storage system to maximize stability, comfort, and weight distribution. Specifically, the backpack 100 weighs approximately 2 pounds to approximately pounds or approximately 3 pounds and has a volume of approximately 40 liters to approximately liter or approximately 55 liters. The large volume of the backpack 100 enables a backpacker to store all of their backpacking gear and the low weight of the backpack 100 enables the backpack 100 to maximize stability, comfort, and weight distribution.

Figure 2:
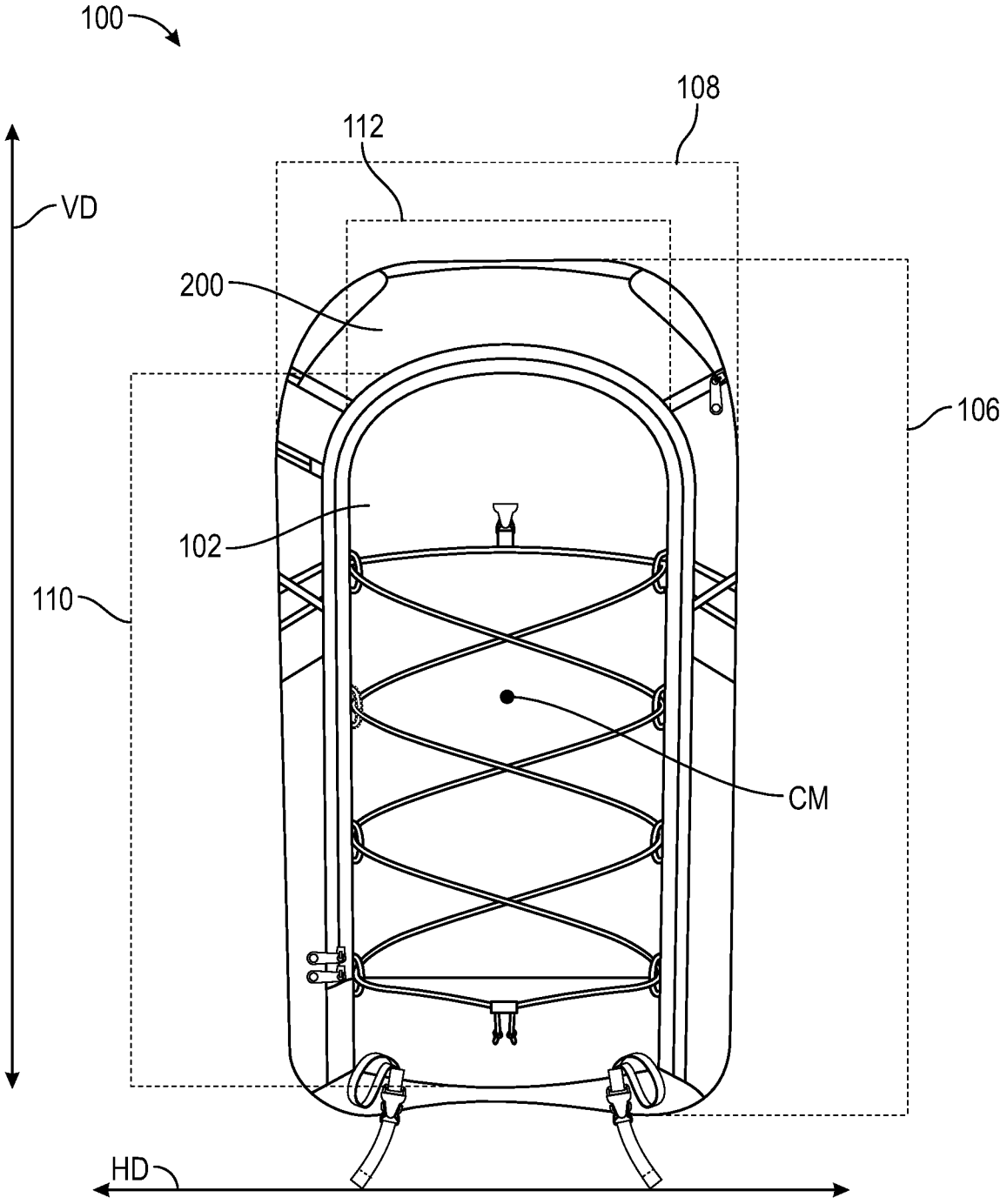
FIG. 2 illustrates a schematic front view of the backpack in accordance with aspects of the present disclosure.

FIG. 2 illustrates a schematic front view of the backpack 100. As shown in FIG. 2, the backpack 100 defines a front panel opening 102 that enables access to an interior space 104 (shown in FIG. 7). The backpack 100 has a backpack height 106, a backpack width 108, a front opening height 110, and a front opening width 112. In the illustrated embodiment, the backpack height 106 is about 25 inches to about 30 inches or about 28.5 inches; the backpack width 108 is about 10 inches to about 20 inches or about 15.25 inches; the front opening height 110 is about 20 inches to about 30 inches or about 24.25 inches; and the front opening width 112 is about 10 inches to about inches or about 11.4 inches. As such, the front panel opening 102 has an area that is approximately 60% to 65% of the front of the backpack 100. That is, the front panel opening 102 occupies over half of the area of the front of the backpack 100 and, when open, provides access to the interior space 104 without forcing the backpacker to empty the rest of the backpack 100.

Figure 3:
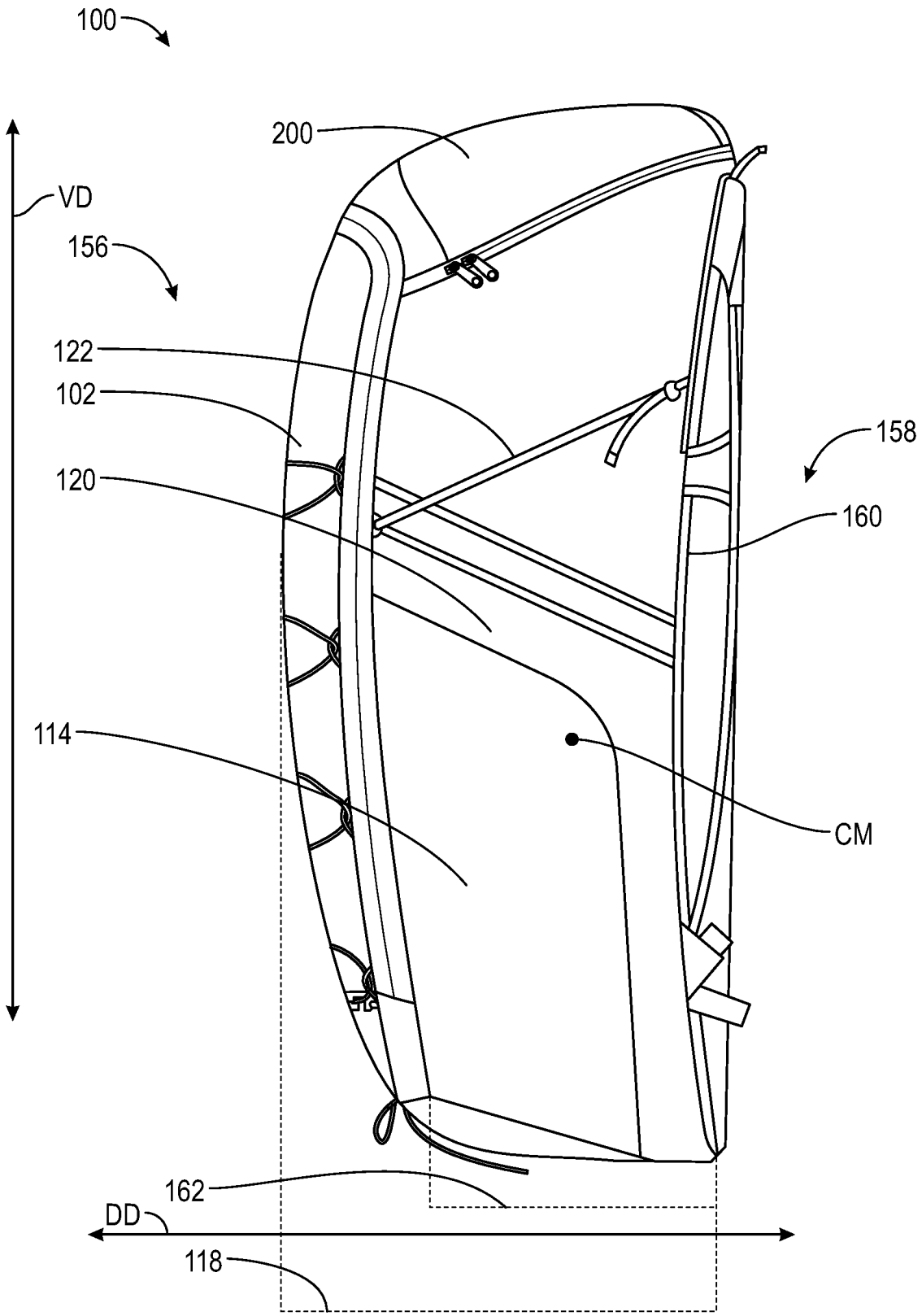
FIG. 3 illustrates a schematic side view of a first side of the backpack in accordance with aspects of the present disclosure.
Figure 4:
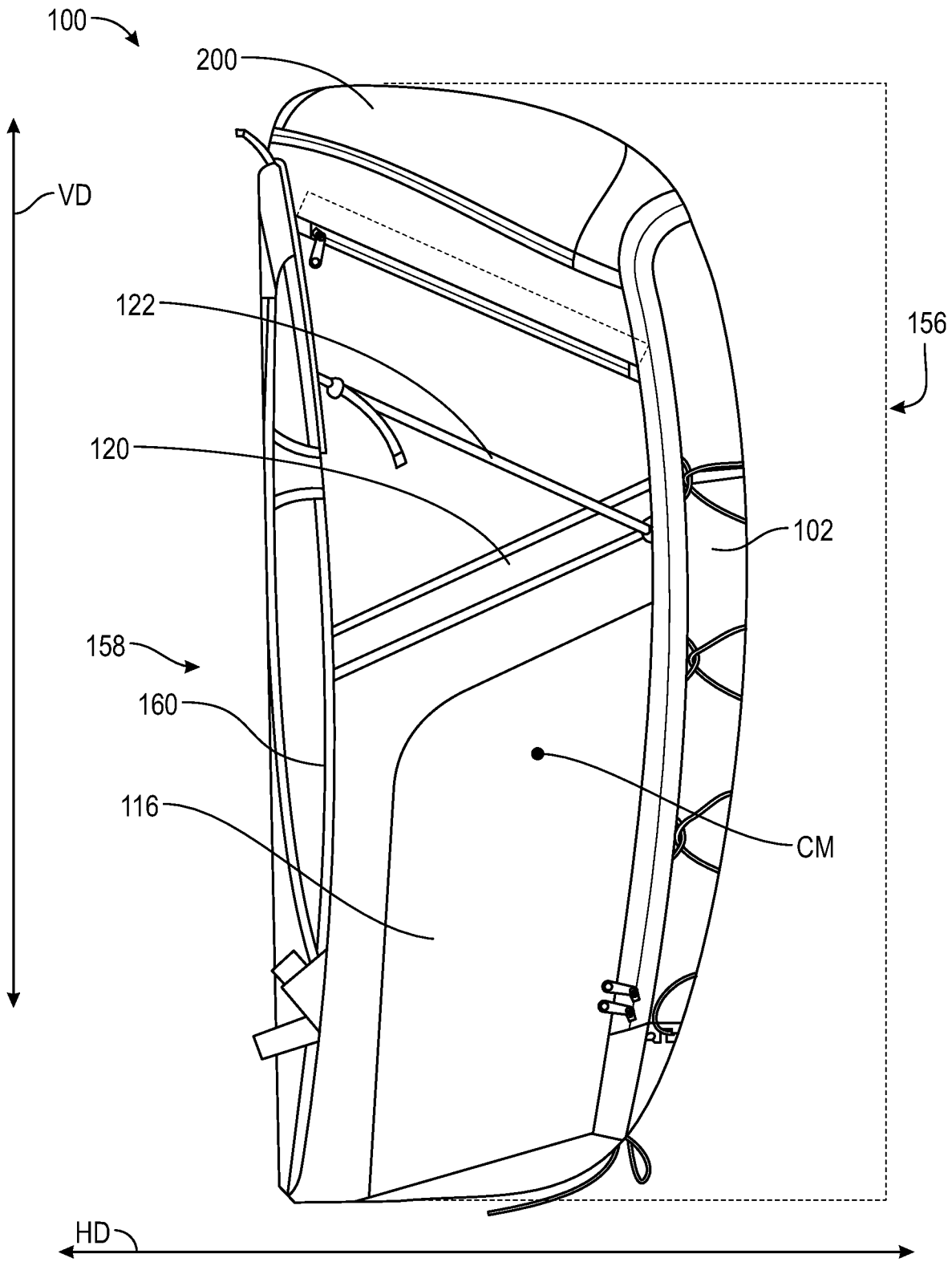
FIG. 4 illustrates a schematic side view of a second side of the backpack in accordance with aspects of the present disclosure.

FIG. 3 illustrates a schematic side view of a first side 114 of the backpack 100. FIG. 4 illustrates a schematic side view of a second side 116 of the backpack 100. As shown in FIGS. 3 and 4, the backpack 100 has a backpack depth 118 of about 10 inches to about 15 inches or about 11.5 inches. Additionally, as shown in FIGS. 2-4, the backpack 100 has a plurality of pockets 120 for storing equipment and a plurality of webbing straps 122 for external attachments. The pockets 120 may be formed of solid fabric or mesh fabric.

As shown in FIGS. 1-4, the backpack 100 has a center of mass CM that is positioned that is approximately centered within the backpack 100 and approximately centered on a backpacker's back. As described herein, the center of mass CM is centered on a backpacker's back for maximum ergonomic comfort by positioning equipment within the backpack 100 based on weight. More specifically, in the illustrated embodiment, the equipment is arranged in the backpack 100 such that the center of mass CM is centered in a horizontal direction HD, a vertical direction VD, and a depth direction DD relative to the backpack 100.

Frame and Pack of the Backpack

Figure 6:
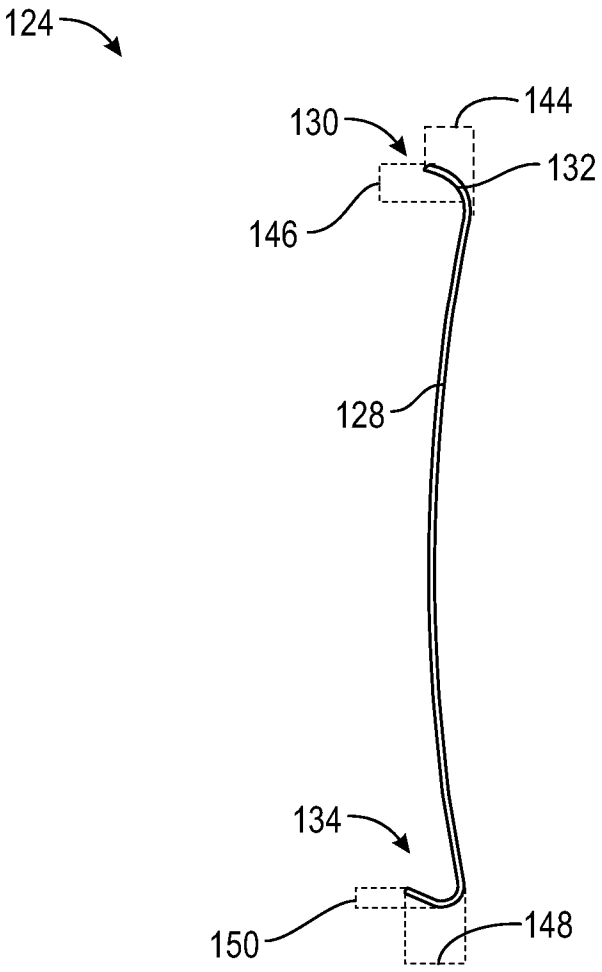
FIG. 6 illustrates a side view of the frame in accordance with aspects of the present disclosure.
Figure 5:
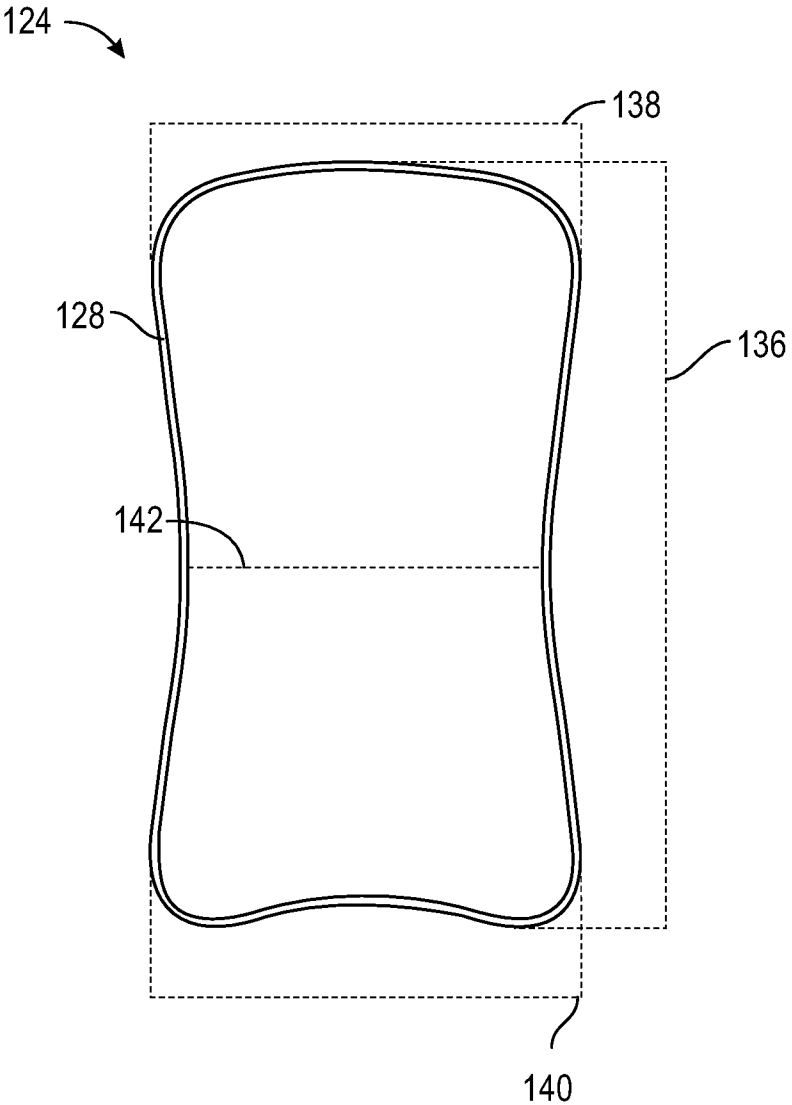
FIG. 5 illustrates a front view of a frame of the backpack in accordance with aspects of the present disclosure.

FIG. 5 illustrates a front view of a frame 124 of the backpack 100. FIG. 6 illustrates a side view of the frame 124. As shown in FIG. 1, the backpack 100 includes a pack 126 supported by the frame 124 to define the interior space 104 (shown in FIG. 7). In the illustrated embodiment, the frame 124 includes a rigid frame. Specifically, in the illustrated embodiment, the frame 124 includes an aluminum wire frame 128 that is shaped for the comfort of the backpacker. Specifically, as shown in FIGS. 5 and 6, the frame 124 has a distinctive shape that contours to the back of the backpacker. For example, a top 130 of the frame 124 has a top bend 132 that curves away from the head of the backpacker. Additionally, a bottom 134 of the frame 124 is curved and contoured around the waist of the backpacker for comfort and cushioning.

Specifically, as shown in FIGS. 5 and 6, the frame 124 has a frame height 136, a frame top width 138, a frame bottom width 140, a frame middle width 142, a top bend length 144, a top bend height 146, a bottom bend length 148, and a bottom bend height 150. The frame height 136 is about 20 inches to about 30 inches or about 24.8 inches; the frame top width 138 is about 10 inches to about 20 inches or about 14 inches; the frame bottom width 140 is about 10 inches to about 20 inches or about 14 inches; the frame middle width 142 is about 10 inches to about 20 inches or about 11.8 inches; the top bend length 144 is about 1 inch to about 2 inches or about 1.5 inches; the top bend height 146 is about 0.5 inches to about 2 inches or about 1 inch; the bottom bend length 148 is about 1 inch to about 3 inches or about 2 inches; and the bottom bend height 150 is about inches to about 1 inch or about 0.5 inches.

The pack 126 is formed of a fabric and stretched around the frame 124 such that the frame 124 at least partially supports the pack 126 in the shape shown herein. In the illustrated embodiment, the pack 126 is formed of nylon. In alternative embodiments, the pack 126 may be formed of any fabric that enables the backpack 100 to operate as described herein. For example, the pack 126 may be formed of any waterproof fabric that enables the backpack 100 to operate as described herein.

In some alternative embodiments, the backpack 100 may not include a frame 124. Rather, the pack 126 determines the shape of the backpack 100 as the interior space 104 is filled with equipment. That is, the equipment within the interior space 104 and other cavities within the backpack 100 fill out or provide volume to the backpack 100 and the pack 126 defines the extent of the shape of the backpack 100. In another alternative embodiment, the frame 124 may include a flexible frame formed of a flexible material. For example, the flexible material may include PVC plastics and may have the same shape as the frame 124 described herein. In other alternative embodiments, the backpack may have any type of frame that enables the backpack 100 to operate as described herein.

The Interior Space of the Backpack

Figure 7:
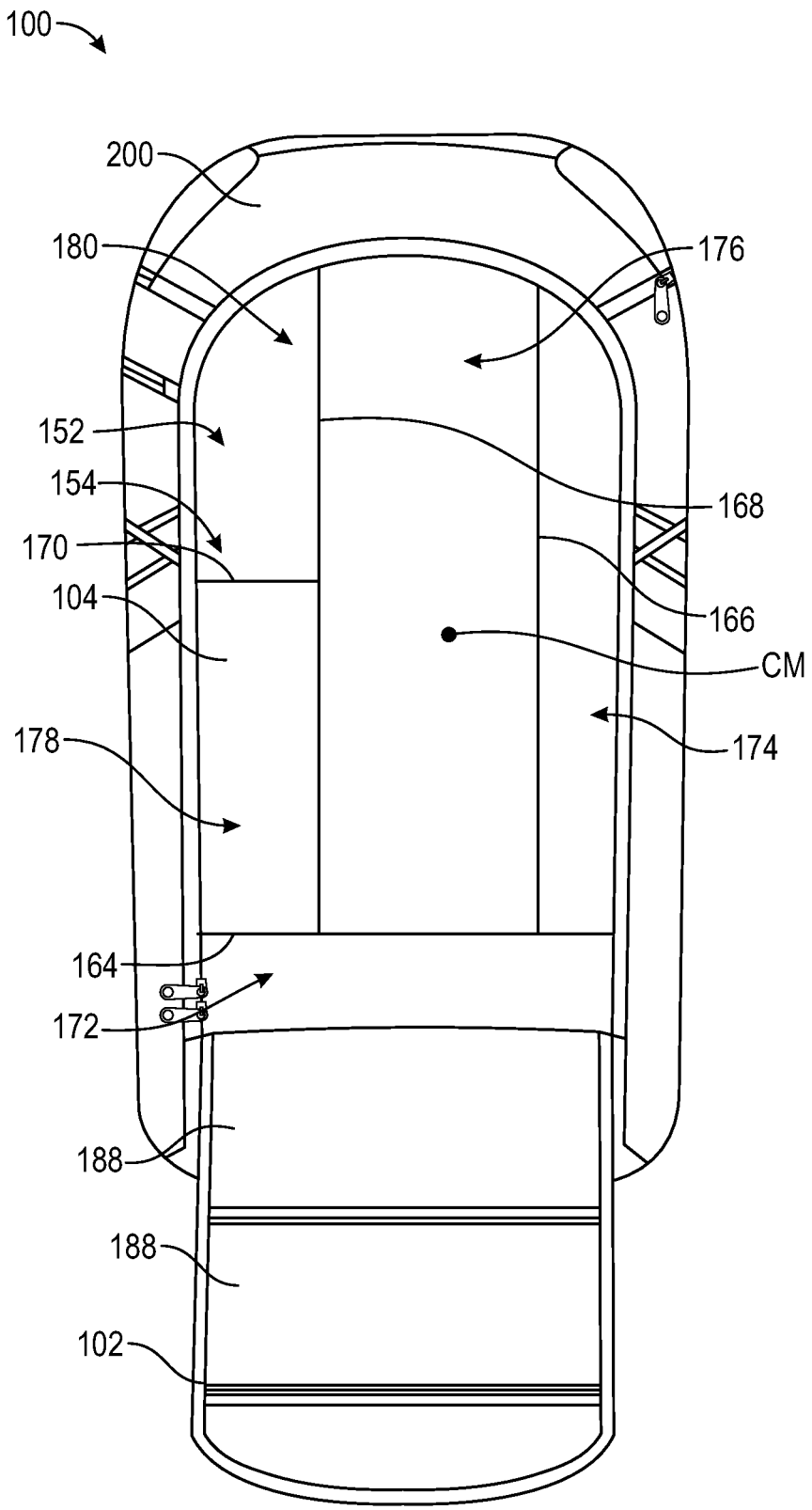
FIG. 7 illustrates a schematic front view of the backpack with the front panel opening open to enable access to the interior space in accordance with aspects of the present disclosure.
Figure 8:
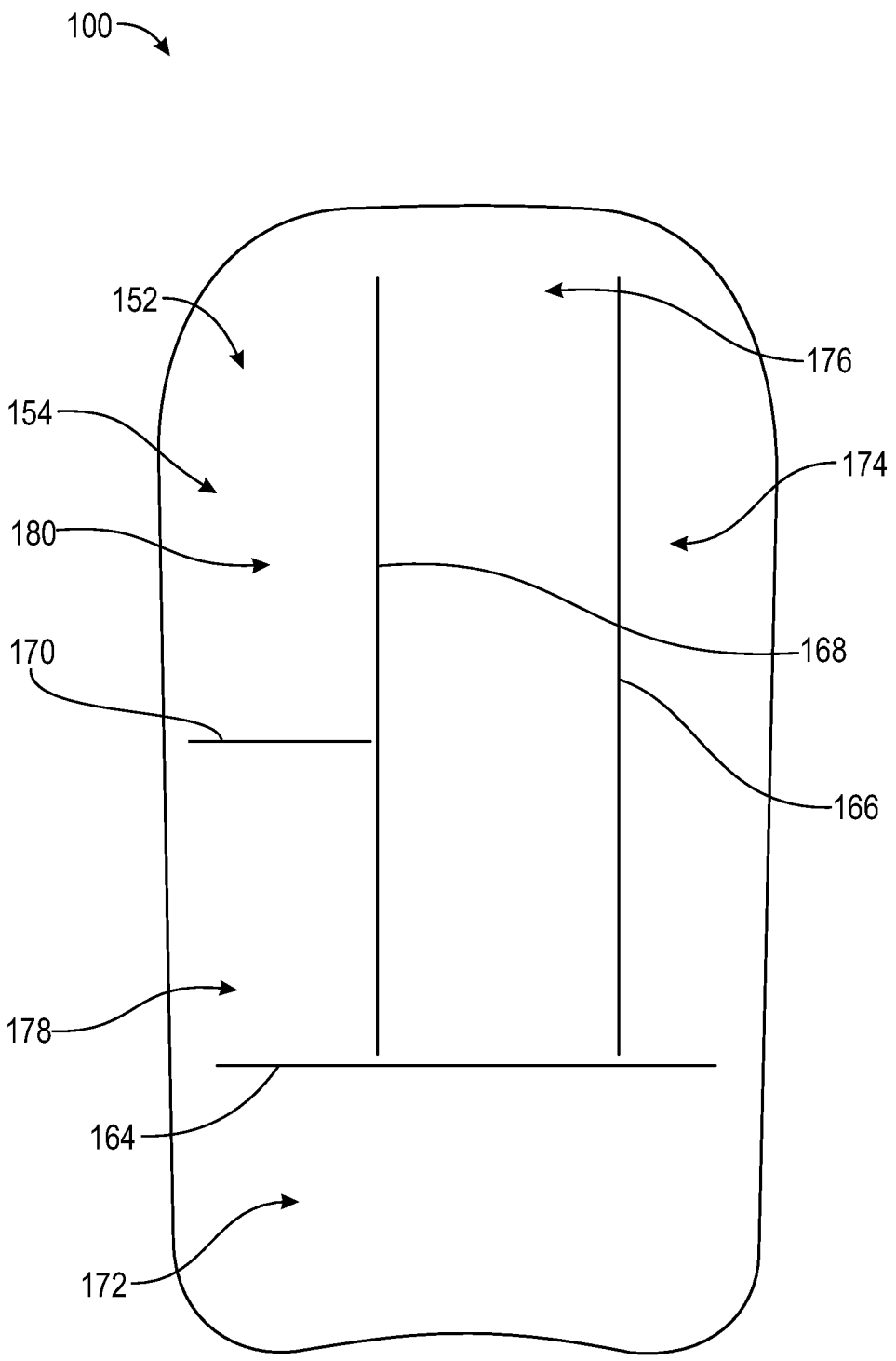
FIG. 8 illustrates a schematic of the interior space of the backpack to illustrate the organization of equipment within the interior space in accordance with aspects of the present disclosure.

FIG. 7 illustrates a schematic front view of the backpack 100 with the front panel opening 102 open to enable access to the interior space 104. FIG. 8 illustrates a schematic of the interior space 104 of the backpack 100 to illustrate the organization of equipment within the interior space 104. As discussed above, the interior space 104 is divided into compartments and each compartment is configured to contain a predetermined piece or pieces of equipment such that the compartments balance the weight of the gear on the backpackers back. The compartments arrange the backpacker's equipment on the backpacker's back such that the weight of the backpack is distributed for stability and comfort.

In the illustrated embodiment, the backpack 100 includes a plurality of dividers 152 that divide the interior space 104 into a plurality of compartments 154. Specifically, in the illustrated embodiment, the backpack 100 includes four dividers 152 that divide the interior space 104 into five compartments 154. In alternative embodiments, the backpack 100 may include any number of dividers 152 that divide the interior space 104 into any number of compartments 154 that enables the backpack 100 to operate as described herein. For example, in alternative embodiments, the backpack 100 may include one, two, three, five, or more dividers 152 and the dividers 152 may divide the interior space 104 into one, two, three, four, six, or more compartments 154.

The dividers 152 include fabric panels that are attached to the pack 126 such that the dividers 152 are oriented in a perpendicular arrangement relative to the front panel opening 102 when the front panel opening 102 is closed. That is, the backpack 100 has a front 156 including the front panel opening 102 and a back 158 including a back panel 160 that is oriented toward the back of the backpacker when the backpacker is wearing the backpack 100. The dividers 152 extend from the front 156 of the backpack 100 to the back 158 of the backpack 100 to sufficiently divide the interior space 104 into the compartments 154. As such, the dividers 152 have a divider depth 162 of about 3 inches to about 8 inches or about 6 inches. The divider depth 162 is long enough to maintain equipment within the compartments 154 even as the backpacker is traversing rough terrain but not so deep as to interfere with the opening and closing of the front panel opening 102.

In the illustrated embodiment, the fabric panels of the dividers 152 include mesh fabric panels. In alternative embodiments, the fabric panels of the dividers 152 may include any fabric that enables the dividers 152 to operate as described herein. For example, in some embodiments, the fabric panels may include nylon fabric panels or some other lightweight fabric. The mesh fabric panels are lightweight and substantially see through, aiding the backpacker in locating equipment within the interior space 104.

In the illustrated embodiment, the backpack 100 includes a first divider 164, a second divider 166, a third divider 168, and a fourth divider 170. Additionally, in the illustrated embodiment, the backpack 100 includes a first compartment 172, a second compartment 174, a third compartment 176, a fourth compartment 178, and a fifth compartment 180. The first divider 164 is oriented in a lateral orientation such that the first divider 164 extends across the interior space 104 from the first side 114 to the second side 116. The first divider 164 divides the interior space 104 such that the first divider 164 and the pack 126 define the first compartment 172.

The backpack 100 includes a top 182 and a bottom 184. The second divider 166 and the third divider 168 are oriented in a vertical orientation such that the second divider 166 and the third divider 168 extend across the interior space 104 from the top 182 of the backpack 100 to the first divider 164. The second divider 166 divides the interior space 104 such that the first divider 164, the second divider 166, and the pack 126 define the second compartment 174. The third divider 168 divides the interior space 104 such that the first divider 164, the second divider 166, the third divider 168, and the pack 126 define the third compartment 176. The fourth divider 170 is oriented in a lateral orientation such that the fourth divider 170 extends across the interior space 104 from the first side 114 to the third divider 168. The fourth divider 170 divides the interior space 104 such that the first divider 164, the third divider 168, the fourth divider 170, and the pack 126 define the fourth compartment 178 and the third divider 168, the fourth divider 170, and the pack 126 define the fifth compartment 180.

The dividers 152 may be removably attached to the pack 126 such that the interior space 104 and the compartments 154 may be individually configured to a backpacker's needs. For example, each divider 152 may include a plurality of clips (not shown) and the pack 126 may include a plurality of corresponding clips (not shown) positioned with the interior space 104. The backpacker may arrange the compartments 154 in any orientation that suits their needs by unclipping and reclipping the dividers 152 in the desired configuration. Additionally, as shown FIG. 7, indicators may be printed on the back panel 160 within the interior space 104 to suggest where the dividers 152 and equipment may be positioned within the interior space 104 to maximize the ergonomic comfort of the backpacker as described below.

The dividers 152 and the compartments 154 are sized and shaped to contain predetermined pieces of equipment to maximize the ergonomic comfort of the backpacker. Specifically, in the illustrated embodiment, the dividers 152 and the compartments 154 are sized and shaped to contain the standard essential equipment the backpacker needs in an organized manner such that the ergonomic comfort of the backpacker is maximized. More specifically, in the illustrated embodiment, the dividers 152 and the compartments 154 are sized and shaped to contain a tent, a sleeping bag, a sleeping pad, cookware, and other equipment in the interior space 104 such that a center of mass CM of the backpack 100 is center on the backpacker's back such that the backpacker is comfortable when carrying the fully loaded backpack.

For example, in the illustrated embodiment, the first compartment 172 is configured to contain a sleeping bag (not shown). In the illustrated embodiment, the sleeping bag is relatively light weight when compared to the tent, the sleeping pad, and the cookware. As such, the sleeping bag is positioned toward the bottom 184 of the backpack 100 and laterally centered to provide maximum stability, comfort, and weight distribution. In the illustrated embodiment, the sleeping bag weighs approximately 1 pounds to approximately 4 pounds or approximately 2 pounds.

The second compartment 174 is configured to contain other equipment (not shown). In the illustrated embodiment, the other equipment is heavier than the sleeping bag but lighter than the tent. As such, the other equipment is positioned toward the top 182 and toward one side 114 or 116 of the backpack 100 to provide maximum stability, comfort, and weight distribution. In the illustrated embodiment, the other equipment weighs approximately 1 pounds to approximately 5 pounds or approximately 3 pounds.

The third compartment 176 is configured to contain the tent (not shown). In the illustrated embodiment, the tent is the heaviest equipment. As such, the tent is positioned toward in the center of the interior space 104 of the backpack 100 to provide maximum stability, comfort, and weight distribution. In the illustrated embodiment, the tent weighs approximately 2 pounds to approximately 6 pounds or approximately 4 pounds.

The fourth compartment 178 is configured to contain the sleeping pad (not shown). In the illustrated embodiment, the sleeping pad is heavier than the sleeping bag but lighter than the tent. As such, the sleeping pad is positioned above the sleeping bag and toward one side 114 or 116 of the backpack 100 to provide maximum stability, comfort, and weight distribution. In the illustrated embodiment, the sleeping pad weighs approximately 1 pounds to approximately 3 pounds or approximately 1.5 pounds.

The fifth compartment 180 is configured to contain the cookware (not shown). In the illustrated embodiment, the cookware is heavier than the sleeping bag and sleeping pad but lighter than the tent. As such, the cookware is positioned toward the top 182 and toward one side 114 or 116 of the backpack 100 to provide maximum stability, comfort, and weight distribution. In the illustrated embodiment, the cookware weighs approximately 1 pounds to approximately 3 pounds or approximately 2 pounds.

Additionally, as shown in FIG. 7, the front panel opening 102 includes a plurality of pockets 188 positioned on the inside of the front panel opening 102. The pockets 188 are configured to hold food within the internal space 104 to protect the food from the elements. Additionally, the pockets 188 are centrally positioned within the internal space 104 such that the center of mass CM of the backpack 100 is not affected by the food. Accordingly, the pockets 188 ensure that the backpack 100 is properly loaded for maximum stability, comfort, and weight distribution.

Moreover, the pack defines a top pouch 200 that includes at least two compartments (not shown) for containing additional equipment. Specifically, in the illustrated embodiment, the top pouch 200 includes three compartments but may include any number of compartments that enables the backpack 100 to operate as described herein. Additionally, the compartments are also labeled with suggestions on how to pack the compartments to maximize stability, comfort, and weight distribution. For example, the compartments may be configured to contain a headlamp, first-aid kit, toiletries, or other miscellaneous small supplies and the labels direct the backpacker how to arrange the equipment in the compartments to maximize stability, comfort, and weight distribution.

The backpack 100 is designed to direct the backpacker how to properly load the backpack 100 for maximum stability, comfort, and weight distribution. Each compartment 154 of the backpack 100 is labeled, with section panels to load the heaviest equipment (i.e., tent, main liquid supply) to be next to the backpacker's and centered in the backpack 100. Medium weight gear (i.e., cookware, sleeping pad) is carried towards the top and outside portions of the backpack 100, and lightweight gear (i.e., sleeping bag) is loaded on the bottom and center of the backpack 100. The equipment is arranged to ensure that the center of mass CM of the backpack 100 is center on the backpacker's back such that the backpacker is comfortable when carrying the fully loaded backpack. More specifically, the center of mass CM was calculated based on the weights and volumes of the equipment described above and the above described arrangement ensured that the center of mass CM is center on the backpacker's back. The arrangement within the internal space 104 helps maximize weight distribution of the backpack 100. Accordingly, the backpack 100 enables a backpacker to quickly and efficiently load and locate their equipment and provides greater comfort to the backpacker because of the weight distribution of the equipment in the backpack.

The Back Panel

Figure 9:
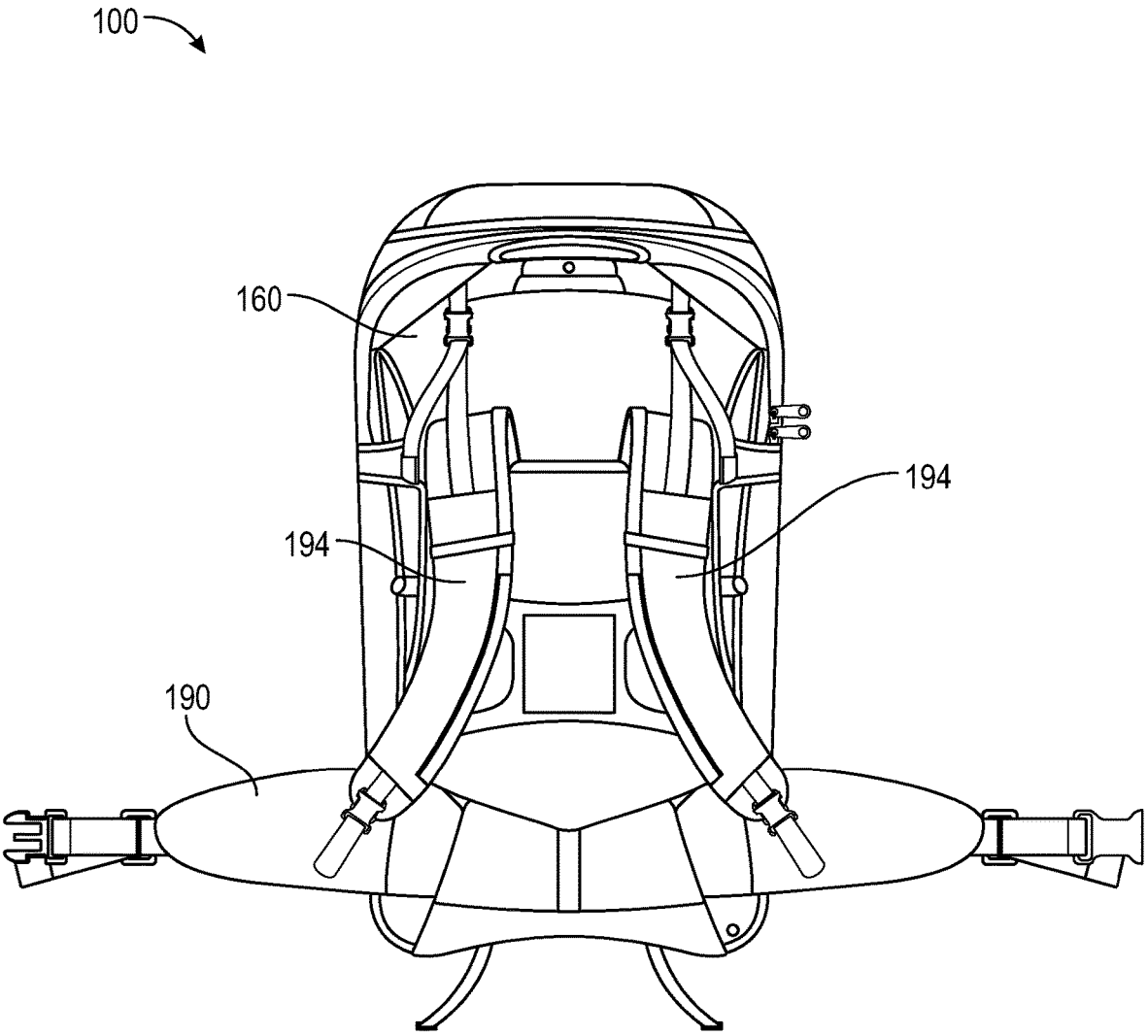
FIG. 9 illustrates a back view of the backpack showing the back panel and a waist belt in accordance with aspects of the present disclosure.
Figure 10:
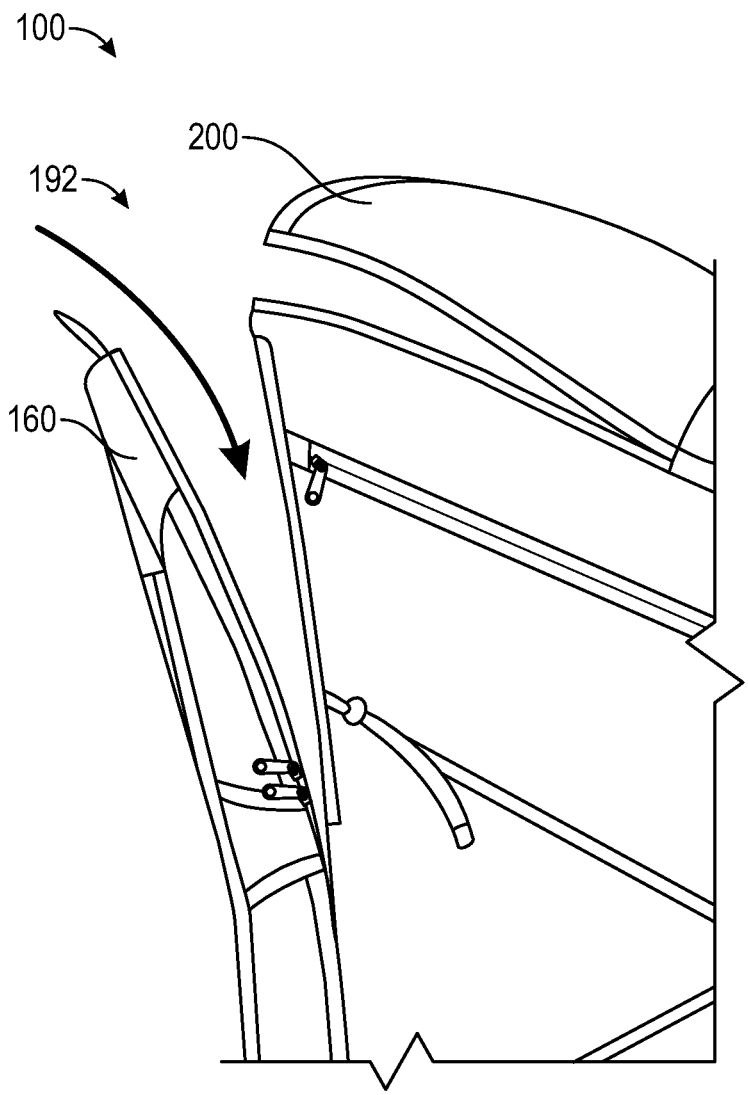
FIG. 10 illustrates a partial side view of the backpack showing a back panel opening for receiving a container of water in accordance with aspects of the present disclosure.

FIG. 9 illustrates a back view of the backpack 100 showing the back panel 160 and a waist belt 190. FIG. 10 illustrates a partial side view of the backpack 100 showing a back panel opening 192 for receiving a container of water (not shown). As shown in FIGS. 9 and 10, the back panel 160 is attached to the back 158 of the backpack 100 and includes shoulder straps 194, the back panel opening 192, and the waist belt 190. The shoulder straps 194 and the waist belt 190 are configured to removably attach the backpack 100 to the backpacker's back. Specifically, the shoulder straps 194 are configured to be worn over the shoulders of the backpacker and the waist belt 190 is configured to wrap around the waist of the backpacker. The combination of the shoulder straps 194 and the waist belt 190 stabilize the backpack 100 on the backpacker's back.

As shown in FIG. 10, the back panel 160 has the back panel opening 192 and defines a water cavity (not shown). The back panel opening 192 provides access to the water cavity and the water cavity is configured to contain the container of water. In the illustrated embodiment, the container of water includes a water bladder (not shown) and a water hose (not shown) attached to the water bladder. The back panel 160 defines a hole (not shown) that receives the water hose such that the backpacker can use the water hose to access the water in the water bladder. Additionally, in the illustrated embodiment, the water bladder has a volume of approximately 85 ounces of water. In alternative embodiments, the water container may be any type of container with any volume of water that enables the backpack 100 to operate as described herein. The water cavity is centrally located such that the center of mass 186 of the backpack 100 is center on the backpacker's back such that the backpacker is comfortable when carrying the fully loaded backpack.

Specifically, because water is typically the heaviest item the backpacker is carrying, the positioning of the container of water is important to maximizing stability, comfort, and weight distribution of the backpack 100. As such, the container of water, in the illustrated embodiment a water bladder, and the water cavity may be labeled with instructions on how to load the container of water into the water cavity. In the illustrated embodiment, the water bladder is flexible and will assume the shape of the water cavity when loaded into the water cavity. As such, the water cavity is positioned within the backpack 100 to be next to the backpacker's back when the backpacker is wearing the backpack 100. Additionally, the water cavity is shaped to force the water bladder to spread such that the water bladder is spread out over the backpacker's back. The arrangement of the water cavity and the water bladder positions the heaviest item in the backpack 100 close to the backpacker's back and distributes the weight of the water across the backpacker's back such that the center of mass CM of the backpack 100 is centered on a backpacker's back for maximum ergonomic comfort.

Center of Mass of the Backpack

As shown in FIGS. 1-10, the backpack 100 has a center of mass CM that is positioned that is approximately centered within the backpack 100 and approximately centered on a backpacker's back. As described herein, the center of mass CM is centered on a backpacker's back for maximum ergonomic comfort by positioning equipment within the backpack 100 based on weight. More specifically, in the illustrated embodiment, the equipment is arranged in the backpack 100 such that the center of mass CM is centered in the horizontal direction HD, the vertical direction VD, and the depth direction DD relative to the backpack 100.

For example, in the illustrated embodiment, the center of mass CM of the backpack 100 is positioned approximately 10 inches from the bottom 184 of the backpack 100, approximately 4 inches from the front 156 of the backpack 100, and approximately 3 inches from the first side 114 when the backpack 100 is fully loaded with equipment and water as described herein. The position of the center of mass CM of the backpack 100 is configured to maximize ergonomic comfort of the backpacker.

Method of Packing a Backpack

Figure 11:
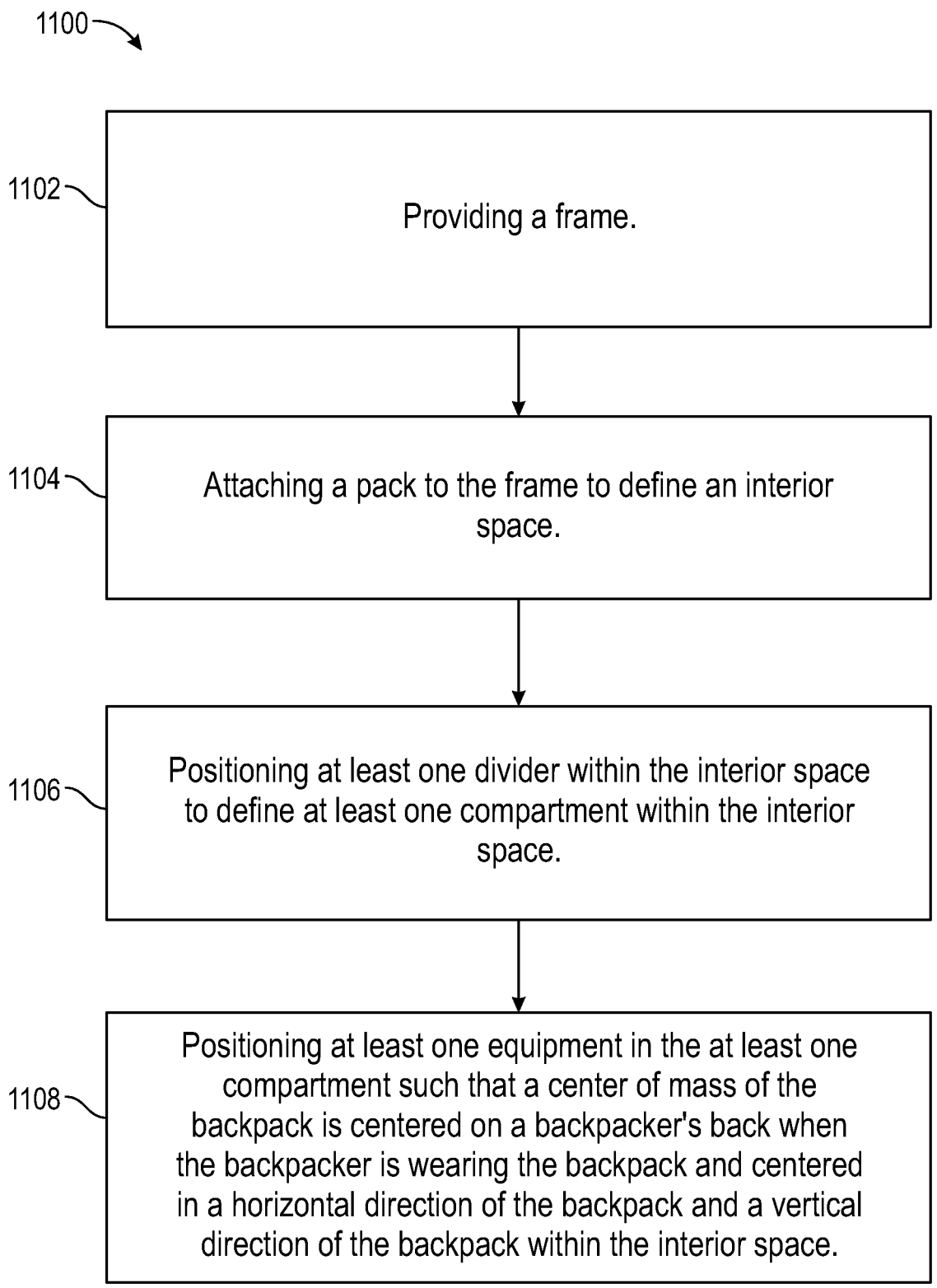
FIG. 11 illustrates a flow diagram of a method of packing a backpack in accordance with aspects of the present disclosure.

FIG. 11 illustrates a flow diagram of a method 1100 of constructing a backpack. The method 1100 includes providing 1102 a frame. The method 1100 also includes attaching 1104 a pack to the frame to define an interior space. The method 1100 further includes positioning 1106 at least one divider within the interior space to define at least one compartment within the interior space. The method 1100 also includes positioning 1108 at least one equipment in the at least one compartment such that a center of mass of the backpack is centered on a backpacker's back when the backpacker is wearing the backpack and centered in a horizontal direction of the backpack and a vertical direction of the backpack within the interior space.

Terminology and Interpretative Conventions

Any methods described in the claims or specification should not be interpreted to require the steps to be performed in a specific order unless stated otherwise. Also, the methods should be interpreted to provide support to perform the recited steps in any order unless stated otherwise.

Spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The terms have, having, include, and including should be interpreted to be synonymous with the terms comprise and comprising. The use of these terms should also be understood as disclosing and providing support for narrower alternative embodiments where these terms are replaced by "consisting" or "consisting essentially of."

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and by applying ordinary rounding techniques.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean,"

etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described in this document.

INCORPORATION BY REFERENCE

The entire content of each of the documents listed below are incorporated by reference into this document. If the same term is used in both this document and one or more of the incorporated documents, then it should be interpreted to have the broadest meaning imparted by any one or combination of these sources unless the term has been explicitly defined to have a different meaning in this document. If there is an inconsistency between any of the following documents and this document, then this document shall govern. The incorporated subject matter should not be used to limit or narrow the scope of the explicitly recited or depicted subject matter.

U.S. Prov. App. No. 63/350,020, titled "Backpack," filed on Jun. 8, 2022.

What is claimed:

1. A backpack comprising:

a frame;

a pack attached to the frame to define an interior space, wherein the frame and the pack define a horizontal direction, a vertical direction, and a depth direction within the backpack;

a plurality of dividers positioned within the interior space to define a plurality of compartments within the interior space, the plurality of dividers each comprising a mesh fabric panel, wherein the plurality of dividers define a first compartment, a second compartment, a third compartment, a fourth compartment, and a fifth compartment, wherein the first compartment is positioned at a bottom of the interior space when the backpacker is wearing the backpack and extends across the interior space, and wherein the third compartment is positioned in a center of the interior space in the horizontal direction and extends from a top of the interior space to the first compartment;

a tent positioned in the third compartment; and a sleeping bag positioned in the first compartment.

2. The backpack of claim 1, wherein the plurality of dividers comprises four dividers.

3. The backpack of claim 2, wherein the four dividers comprise a first divider, a second divider, a third divider, and a fourth divider, and wherein the first divider and the pack define the first compartment.

4. The backpack of claim 3, wherein the first divider is oriented in a lateral orientation.

5. The backpack of claim 3, wherein the first divider, the second divider, and the pack define the second compartment.

6. The backpack of claim 5, wherein the second divider is oriented in a vertical orientation and the second compartment is configured to contain other equipment.

7. The backpack of claim 3, wherein the first divider, the second divider, the third divider, and the pack define the third compartment.

8. The backpack of claim 7, wherein the third divider is oriented in a vertical orientation.

9. The backpack of claim 3, wherein the first divider, the third divider, the fourth divider, and the pack define the fourth compartment.

10. The backpack of claim 9, wherein the fourth divider is oriented in a lateral orientation and the fourth compartment is configured to contain a sleeping pad.

11. The backpack of claim 3, wherein the third divider, the fourth divider, and the pack define the fifth compartment.

12. The backpack of claim 11, wherein the fourth divider is oriented in a lateral orientation and the fifth compartment is configured to contain cookware.

13. The backpack of claim 1 further comprising a front panel opening.

14. The backpack of claim 13, wherein the front panel opening has an area that is 60% to 65% of a front of the backpack.

15. A method of constructing a backpack, the method comprising:

providing a frame;

attaching a pack to the frame to define an interior space;

positioning a plurality of dividers within the interior space to define a first compartment, a second compartment, a third compartment, a fourth compartment, and a fifth compartment within the interior space, wherein the first compartment is positioned at a bottom of the interior space when the backpacker is wearing the backpack and extends across the interior space, and wherein the third compartment is positioned in a center of the interior space in the horizontal direction and extends from a top of the interior space to the first compartment;

positioning a tent in the third compartment; and positioning a sleeping bag in the first compartment.

* * * * *